US007380669B2

(12) United States Patent
Hacking, Jr. et al.

(10) Patent No.: US 7,380,669 B2
(45) Date of Patent: Jun. 3, 2008

(54) APPARATUS AND METHOD FOR SORTING AND RECOMBINING MINERALS INTO A DESIRED MIXTURE

(76) Inventors: Earl L. Hacking, Jr., N2780-730th St., Hager City, WI (US) 54014; Thomas A. Swaninger, 15235 Pinewood Trail, Linden, MI (US) 48451

( * ) Notice: Subject to any disclaimer, the term of this patent is extended or adjusted under 35 U.S.C. 154(b) by 526 days.

(21) Appl. No.: 10/874,087

(22) Filed: Jun. 22, 2004

(65) Prior Publication Data

US 2005/0279675 A1 Dec. 22, 2005

(51) Int. Cl.

| | |
|---|---|
| ***B01F 15/04*** | (2006.01) |
| ***B07C 5/02*** | (2006.01) |
| ***B03B 7/00*** | (2006.01) |
| ***B07B 9/00*** | (2006.01) |

(52) U.S. Cl. ..... 209/17; 209/10; 209/3.2; 366/160.1

(58) Field of Classification Search ..... 209/3, 209/10, 12.1, 17, 3.2, 710, 711, 712, 726, 209/728, 729; 366/16, 17, 152.1, 160.1
See application file for complete search history.

(56) References Cited

U.S. PATENT DOCUMENTS

| | | | | |
|---|---|---|---|---|
| 2,179,485 | A | 11/1939 | Avril | |
| 3,182,969 | A | 5/1965 | Rupp | |
| 3,547,411 | A | 12/1970 | Sowell | |
| 3,638,791 | A * | 2/1972 | Harrison | 209/39 |
| 3,868,262 | A | 2/1975 | Ohlson | |
| 4,032,436 | A | 6/1977 | Johnson | |
| 4,152,257 | A | 5/1979 | Giffard | |
| 4,222,787 | A | 9/1980 | Jones | |
| 4,409,096 | A | 10/1983 | O'Brian | |
| 4,436,433 | A | 3/1984 | Barnes | |
| 4,619,550 | A | 10/1986 | Jeppson | |
| 4,712,742 | A | 12/1987 | Ogawa et al. | |
| 5,022,317 | A | 6/1991 | Williams | |
| 5,076,702 | A | 12/1991 | Smals | |
| 6,085,912 | A * | 7/2000 | Hacking et al. | 209/17 |
| 6,786,941 | B2 * | 9/2004 | Reeves et al. | 44/503 |
| 6,796,432 | B2 * | 9/2004 | Soldwish-Zoole et al. | 209/156 |
| 6,926,465 | B1 * | 8/2005 | Mann et al. | 405/128.45 |
| 7,147,788 | B2 * | 12/2006 | Tveiten | 210/788 |
| 2002/0074269 | A1 * | 6/2002 | Hensley et al. | 209/726 |
| 2004/0164005 | A1 * | 8/2004 | Allen, III | 209/725 |
| 2004/0232052 | A1 * | 11/2004 | Call et al. | 209/143 |
| 2004/0251178 | A1 * | 12/2004 | Afsari et al. | 209/582 |

* cited by examiner

*Primary Examiner*—Patrick Mackey
*Assistant Examiner*—Mark Hageman
(74) *Attorney, Agent, or Firm*—James J. Paige; Nikolai & Mersereau, P.A.

(57) ABSTRACT

A method and apparatus is employed to create a mixture having a desired composition. A raw material is separated in a pair of density separators into constituent parts. Those parts are then recombined in a desired fashion using a pair of splitters to create an intermediate mixture and delivered to a third density separator. The third density separator processes the intermediate mixture to create a final mixture having the desired composition.

13 Claims, 3 Drawing Sheets

APPARATUS AND METHOD FOR SORTING AND RECOMBINING MINERALS INTO A DESIRED MIXTURE

BACKGROUND OF THE INVENTION

I. Field of the Invention

The present invention relates to an apparatus and method for sorting mixtures of materials into constituent parts and then recombining the constituent parts into mixtures of a desired ratio. In its simplest form, the apparatus of the present invention uses two or more density separators, a separate control valve associated with each density separator, a separate differential pressure sensor associated with each density separator and at least two splitters, all operated under program control, to first divide a mixture of minerals into constituent parts and then use the constituent parts to create an end product of a predetermined composition. The program used to control the equipment can, of course, be altered to change the composition of the end product.

II. Description of the Related Art

It is well known in the construction arts that the nature and durability of various construction materials which incorporate sand or other granular mineral materials vary based upon the particle size distribution of the granular material used. Thus, various techniques have been employed in the prior art to treat raw sand and other granular materials, the constituent parts of which are of an unknown and non-uniform size, to obtain at least one end product which meets the desired specification. The same techniques have been employed with other particulate materials. Prior art techniques often incorporate the use of one or more density separators which divide a source material into a relatively coarse underflow fraction and a relatively fine overflow fraction. The density separators typically include equipment, such as a valve, for varying the size of the material as required by varying the flow rate of the underflow fraction in relation to the pulp density within the density separator. By using a density separator to separate the raw material into two constituent parts, stockpiles of the constituent parts can be created.

To meet the specification requirements for a particular mixture, a desired blend of the two constituent products can be created. In the prior art, this has typically been done by storing the constituent parts separately in bins and then drawing from the bins whatever relative weights of materials are required for the desired blending. This technique suffers from several disadvantages. First is the cost of the weigh scales and the bins. Second is the space required for such equipment and storage of the constituent parts. Third is the lack of uniformity of blending produced with such equipment due to unpredictable flow rates and non-uniform moisture content of the raw materials used.

U.S. Pat. No. 6,085,912 which issued on Jun. 11, 2000 to Earl L. Hacking, Jr. and Thomas A. Swaninger discloses a system that solves many of the problems outlined in the prior art. The invention disclosed in the '912 patent is directed to an apparatus for separating a first mixture of substantially granular materials into its constituent parts and then remixing constituent parts to achieve a second mixture having a desired composition. This apparatus includes a first density separator which divides the first mixture into first and second flow streams. The first flow stream consists of a first material having a first controlled density or size. Likewise, the second flow stream consists of a second material having a second controlled density and size less than the first controlled density or size. This apparatus also includes a control valve for regulating the exit of the first flow stream from the density separator and for controlling the division of the first mixture into first and second flow streams by the first density separator. A first sensor is also provided. This sensor generates an electrical signal indicative of the rate at which material within the first flow stream is exiting the density separator. The system also includes a second sensor which provides a signal indicative of the pulp density of the material within the first density separator. A splitter is associated with the first flow stream exiting the density separator for controlling the delivery of the material in that flow stream. A controller is also provided to respond in real time to signals provided by the sensors to automatically control the control valve and the splitter to produce an ingredient having a desired composition. The patent goes on to explain how ingredients created using this technique can be recombined to make desired products.

FIG. 1 of the '912 patent specifically shows how a pair of such density separators and splitters can be used in conjunction with other equipment to create at least six different constituent products.

The present invention represents an improvement over what is shown in U.S. Pat. No. 6,085,912. It provides greater flexibility in combining materials to achieve the precise end product desired without, at the same time, creating numerous other less desirable end products. Thus, the present invention improves on the efficiency achieved by the system shown in the '912 patent and also reduces the space required to produce a desired product.

SUMMARY OF THE INVENTION

The present invention utilizes two or more density separators, at least two splitters, and a variety of sensors to create a desired end product. When three density separators are used, raw unprocessed granular material can be placed in the first two density separators. Each of these density separators separate the material into a coarse fraction of raw material and an intermediate fraction of lesser density or smaller size that can be used for further processing. The intermediate fraction of the first density separator is fed into a splitter associated with the third density separator. The intermediate fraction of the second density separator is fed into a separate splitter, controlled by the controller to meter the desired portion of this intermediate fraction into the. splitter associated with the third density separator. Input of the mixture of intermediate materials to be processed further by the third density separator is controlled using the first density separator, the second density separator, and the two splitters. The third density separator is then used in conjunction with the first two density separators to process this mixture of intermediate material further to yield the desired end product.

For a better understanding of the present invention, and to show more clearly how the same may be carried into effect, reference is made to the accompanying drawing of the preferred embodiment to the invention. Various other embodiments can also be assembled using the constituent parts of the invention as shown in the drawing without deviating from the invention.

DETAILED DESCRIPTION OF A PREFERRED EMBODIMENT

Figure 1:
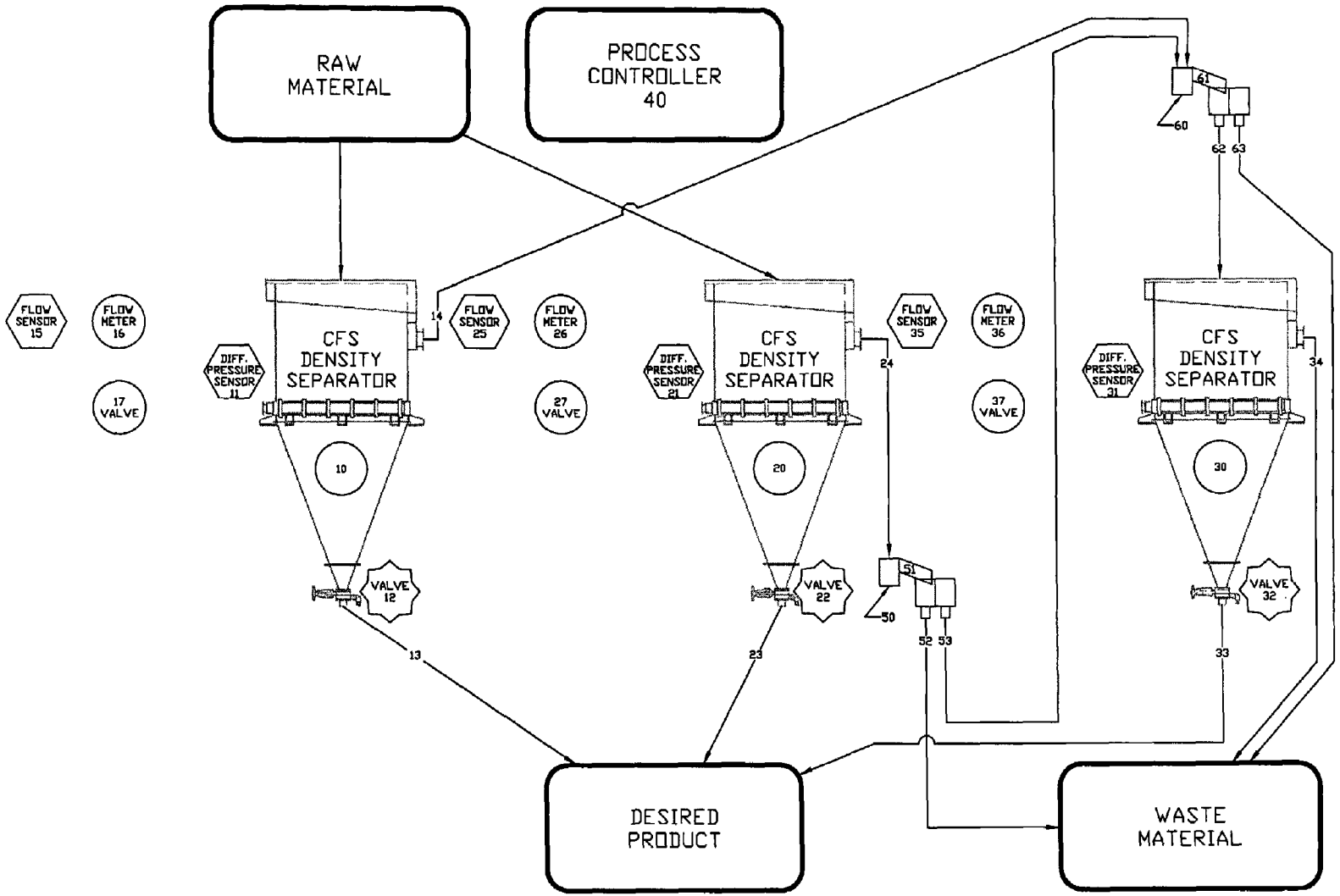
FIG. 1 is a schematic diagram of a blending plant constructed in accordance with the present invention showing the flow of material through the blending plant.

As shown in FIG. 1, a preferred embodiment of the present invention includes three density separators 10, 20 and 30. Each density separator is equipped with a differential pressure sensor 11, 21 and 31 and a valve 12, 22 and 32. Each density separator has a bottom discharge port 13, 23 and 33, as well as an upper discharge port 14, 24 and 34. Material supplied to each density separator is divided into a first underflow fraction which exits the density separator's bottom port and an overflow fraction which exits the density separator's upper port. Also associated with each density separator is a water flow sensor 15, 25 and 35, a water flow meter 16, 26 and 36, as well as a water flow valve 17, 27 and 37. The entry of water into the density separators is controlled by these valves.

The system of the present invention also includes a pair of splitters 50 and 60. Each splitter has an input 51, 61 and a pair of outputs 52, 53 and 62, 63.

Figure 2:
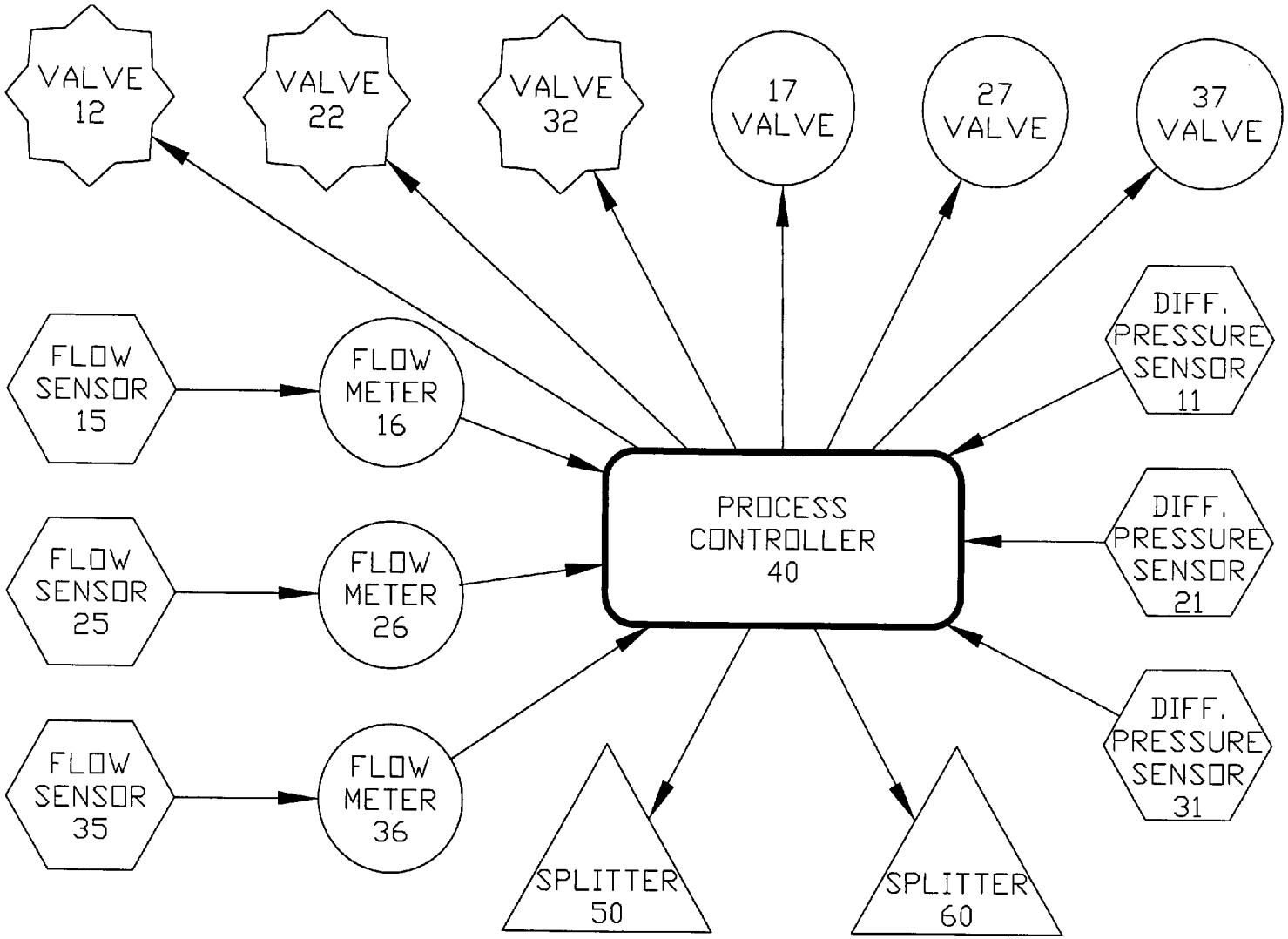
FIG. 2 is a block diagram of a blending plant constructed in accordance with the present invention.
Figure 3:
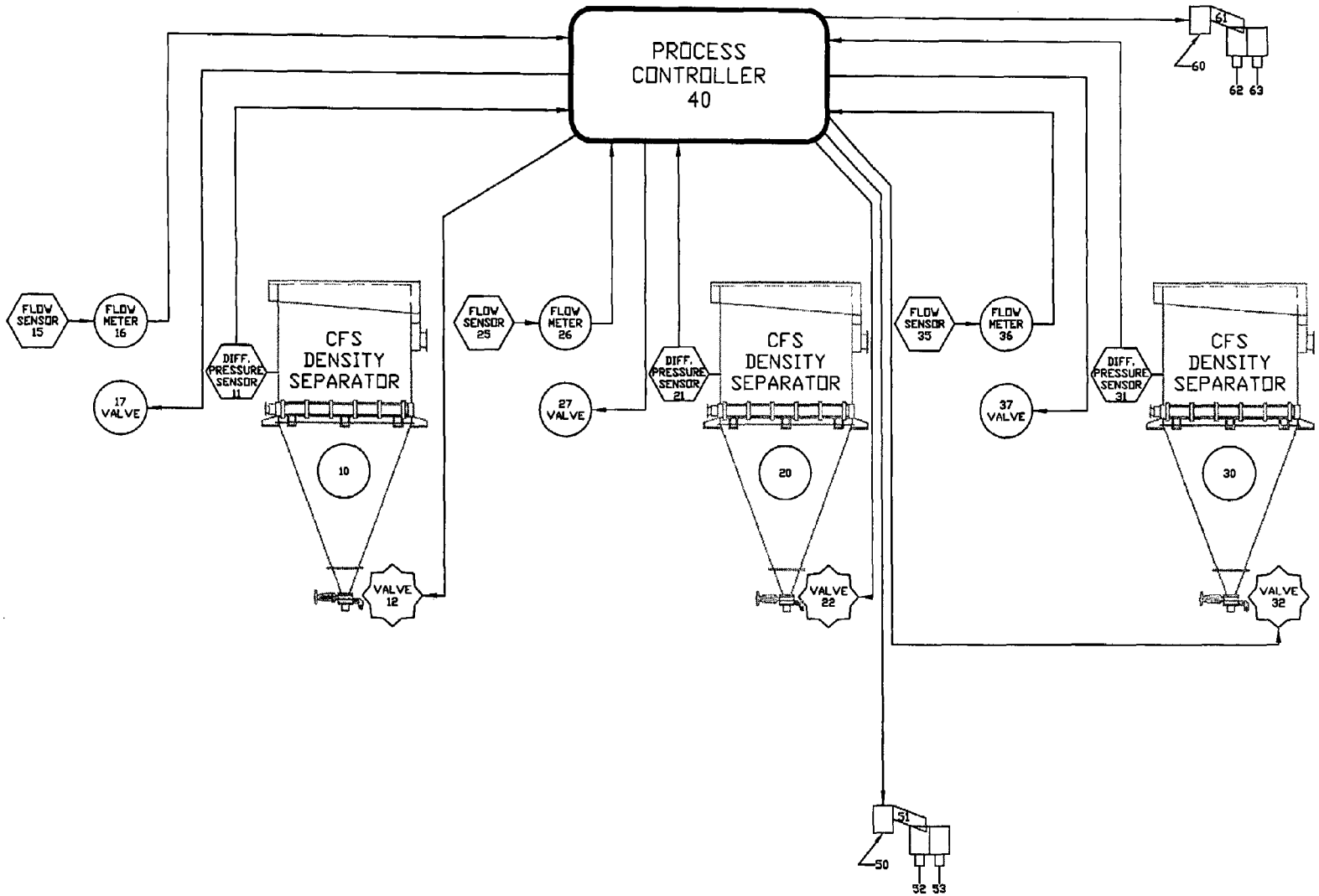
FIG. 3 is a schematic diagram of a blending plant constructed in accordance with the present invention and showing an alternative form, the paths of electrical signals between the process controller, the sensors and the equipment controlled by the process controller.

Operation of the above described equipment is controlled by a process controller 40. As shown in FIG. 2, the process controller 40 receives input signals from the flow sensors 15, 25 and 35 as well as the differential pressure sensors 11, 21 and 31. Based upon these signals, user-defined parameters, and a set of software instructions, the process controller provides control signals to the flow valve 17, 27 and 37; the discharge valves 12, 22 and 32; and the splitters 50 and 60 so that the desired end product is produced with minimal waste.

When the invention of the present invention is used, raw sand is deposited into the top of the first density separator 10. By controlled operation of the flow meter 16 and valve 12 based upon signals received from the flow sensor 15 and differential pressure sensor 11, the density separator divides the sand into a coarse underflow fraction that exits the density separator through port 13 and a fine overflow intermediate fraction of a desired density and/or size which exits the density separator 10 through the port 14. Similarly, raw sand is deposited into the density separator 20. Based upon signals received from the flow sensor 25 and the differential pressure sensor 21, the controller 40 operates the flow meter 26 and the valve 22 to separate the raw sand deposited into the density separator 20 into a coarse underflow fraction which exits through port 23 and a second fine overflow intermediate fraction of a desired density and/or size through the port 24.

The intermediate fraction exiting port 14 of density separator 10 is transported to the input 61 of the splitter 60. The intermediate fraction exiting port 24 of density separator 20 is transported to the input 51 of splitter 50. The controller 40 operates the splitter 50 to divide this material between outputs 52 and 53 of the splitter. Specifically, the controller 40 operates the splitter 50 so that the desired quantity of material that exited port 24 of density separator 20 is transported from the output 53 of splitter 50 to the input 61 of splitter 60. The remainder exits splitter 50 via output 52. In this way, the controller 40 is able to control the composition of the mixture of intermediate materials deposited into the density 30.

In a similar fashion, the splitter 60 is controlled by the controller 40 to regulate the quantity of the mixture of intermediate materials deposited into the density separator 30. Material exiting splitter 60 via port 62 is deposited into the density separator 30. Given the above configuration, the material used to form the desired end product exits density separator 10 via port 13, density separator 20 via port 23 and density separator 30 via port 33. On the other hand, waste material exits the system via output 52 of splitter 50 and via output 63 of splitter 60 as well as discharge port 34 of density separator 30. The controller of the present invention can be programmed to provide a final product having a desired composition. For example, the controller is provided with an input which permits the user to indicate the desired ratio of material exiting port 33 in relation to the sum exiting ports 13 and 23.

In the embodiment shown in the drawings, the operating density of density separators 10 and 20 is controlled by the modulation of valves 12 and 22 respectively in response to commands from process controller 40 based upon inputs from the controller 40 from differential pressure sensors 11 and 21. In the case of density separator 30, the operating density is controlled by addition of material to density separator 30 via output 62 of splitter 60 in response to commands from process controller 40 based upon signals received from sensor 31.

Significant advantages are achieved by the present invention because the controller 40 controls three separate aspects of the operation of density separator 30. As was the case in the prior art, the controller 40 controls the water flow valve 37 and the valve 32 based upon signals received from the flow sensor 35 and differential pressure sensor 31. In the present invention, the controller 40 also operates splitters 50 and 60 to control the composition and quantity of the material (i.e., the mixture of intermediate materials) delivered to the density separator 30.

The density separator 30 is then used to produce a product of a desired composition. Signals received from the flow sensor 35 and the differential pressure sensor 31 by the controller can control the water flow valve 37, the splitter 60 and the valve 32 to process the material deposited into the splitter 60 to create a product having a desired composition. Such product could be the material exiting the density separator 30 through port 33, but is more likely the material that exits the density separator through the port 30. The system of the present invention is able to uniquely control the composition of the product by not only modulating the valve 32 and the water flow valve 37 but also by controlling the other two density separators and both splitters 50 and 60 to control the composition and quantity of the mixture of material delivered into the density separator 30. Through such control and further control, a significantly greater degree of accuracy in producing the desired product can be achieved.

From the foregoing, it should be clear how three or more density separators can be used to achieve a desired composition. If, for example, space or equipment cost is an overriding issue, the density separator 20 can be eliminated and the present invention still practiced. In such a configuration, raw material is deposited into the density separator 10 to divide the raw material into a first desired fraction and a first intermediate fraction.

In FIG. 1, the first desired fraction exits the density separator 10 via port 13 and the first intermediate fraction exits via the port 14. This, of course, can be revised. In either case, the first intermediate fraction is then deposited into the other density separator (density separator 30) for further processing. During this processing step, the first intermediate fraction is divided into a second desired fraction and a second intermediate fraction. The first and second desired fractions can then be combined in a desired ratio to provide a mixture having a desired composition. Either the valves 12 and 32 or other equipment controlled by process controller 40 can be modulated to achieve the desired mixture of the end product.

A significant problem in the prior art was the inability to retrieve in a predicable or controlled way from a stockpile of material a desired composition and quantity of material for a specific application. The present invention overcomes this problem by permitting a material of a desired composition to be precisely metered in the quantity desired for the specific application.

Another problem in the prior art was the inability to estimate the average size of the raw material being deposited into a density separator. Such an estimation can be provided by the controller 40 of the present invention if the quantity of raw material delivered to the first density separator and the quantity exiting one of the ports of the density separator is measured and signals representative of these measurements are supplied to the controller 40. The controller 40 can then calculate the quantity exiting the other port of the density separator by subtraction and compare the ratio of the material exiting the first and second ports to the known size at which particles are separated by the density separator to determine the average size of the particles of the raw material. Devices (not shown) used to measure the quantity of material entering or exiting the density separator can be of any known type capable of providing a signal indicative of quantity to the controller 40. From the foregoing those skilled in the art will recognize that the system of the present invention also functions as a particle size indicator when creating the mixture of material desired by the operator.

Systems of the type described above are often placed in remote locations and likewise are often unattended. Such equipment can also be affected by lighting strikes and power surges. Therefore, it is advantageous to be able to remotely monitor the operation of the system and to be able to remotely program the process controller 40.

This is achieved by providing a connection between the process controller 40 and a remote computer. Such connection can be provided in any number of ways including, but not limited to, a telephone connection and modem, an Ethernet connection to the Internet, or even using cellular or satellite data communication techniques. Through this connection, the operator of the system can monitor its performance remotely and can also transmit programmable parameters to the process controller 40 to alter the operation of the plant whenever a different product is desired. Suitable security such as password protection is provided to prevent accidental or unauthorized reprogramming of the controller 40.

Generally, the method disclosed thus far adjusts a PID control loop made of a differential pressure cell, varying water current, and modulating discharge valve. This determines the specific gravity and height of the slurry in the density separator such that they are maintained irrespective of the feed gradation or feed rate provided to the density separator.

A further embodiment of this invention includes a method by which wet blended slurries of material are produced displaying more consistent flow characteristics. This additional embodiment uses similar instrumentation and a similar valve but instead varies the feed to the unit, whereby the bed height and specific gravity in the tank are maintained. Maintaining the bed or separation point in this way requires the second density separator to be either loaded or bypassed. The valve at the bottom of the second density separator is now controlled based upon a blend ratio from the first density separator. This is accomplished when the feed gate of the second density separator maintains a constant bed height by adjusting the feed control to the second density separator.

In this way the $1^{st}$, $2^{nd}$ and $3^{rd}$ density separators become large holding tanks that discharge predetermined ratios of blends: coarse, medium, and fine with the same ingredients—4×30 mesh, 30×50 mesh—in each density separator. All blends are recombined as a wet blended slurry, which flows much more consistently than the dry/damp bin storage silo of competitive systems (i.e.: 4×30 mesh is free flowing, whereas 30×50 mesh and 50×200 mesh do not flow well or consistently).

A density separator with feed control (or varying feed) gate has the ability to maintain a constant tonnage of high percent underflow. Processes such as grinding circuits or froth floatation circuits become more productive if they can be fed by constant tonnage and constant high percent solids. The density separator with feed control improve these circuits while making a very accurate separation. The addition of PID feed control to the density separator will give a constant tonnage and constant high percent solids (i.e., 100 STPPH underflow at 78% solids). See FIG. 4.

What is claimed is:

1. A method for producing a desired mixture of a granular material comprising the steps of:

a. using a first density separator comprising a tank to separate raw mixture into a first desired fraction and a first intermediate fraction;

b. using a second density separator comprising a tank to separate a raw mixture into a second desired fraction and a second intermediate fraction;

c. using a pair of splitters to create a desired intermediate mixture of said first and second intermediate fractions and deliver a desired quantity of said intermediate mixture to a third density separator; and d. using said third density separator to separate said desired quantity of said intermediate mixture into a waste fraction and a fraction which is added to the once separated first desired fraction and the once separated second desired fraction to produce a desired mixture of a granular material.

2. The method of claim 1 further comprising the steps of indicating the average particle size of the raw material delivered to the first density separator by measuring the quantity of material delivered to the density separator, measuring the quantity of material exiting one of the ports of the density separator, calculating the quantity exiting the other port of the density separator, making a comparison of the ratio of the materials exiting the ports of the density separator to the known size at which particles are separated by the density separator, and using the result of said comparison to control the operation of at least one of said first density separator, second density separator, said pair of splitters, or said third density separator.

3. The method of claim 1 wherein the operation of said density separators is controlled by a controller.

4. The method of claim 3 wherein said controller transmits data to a remote computer.

5. The method of claim 3 wherein said controller receives programmable parameters from a remote computer.

6. The method of claim 3 wherein the controller, determines the specific gravity and the height of the mixtures in the density separators such that these are maintained irrespective of the feed gradation or feed rate provided to the density separators.

7. The method of claim 1 wherein the quantity of material supplied to at least one of said density separators is varied to maintain the bed height and specific gravity of the contents of the tank of said at least one of said density separators.

8. A method for producing a desired mixture of a granular material comprising the steps of:

a. using a first density separator comprising a tank to separate raw mixture into a once separated first desired fraction and a first intermediate fraction;

b. using a second density separator comprising a tank to separate a raw mixture into a once separated second desired fraction and a second intermediate fraction;

c. using a pair of splitters to create a desired intermediate mixiure of said first and second intermediate fractions and deliver a desired quantity of said intermediate mixture to a third density separator;

d. using said third density separator to separate said desired quantity of said intermediate mixture into a waste fraction and a fraction which is added to the once separated first desired fraction and the once separated second desired fraction to produce a desired mixture of a granular material; and e. wherein the quantity of material supplied to at least one of said density separators is varied to maintain the bed height and specific gravity of the contents of the tank of said at least one of said density separators.

9. The method of claim 8 further comprising the steps of indicating the average particle size of the raw material delivered to the first density separator by measuring the quantity of material delivered to the density separator, measuring the quantity of material exiting one of the ports of the density separator, calculating the quantity exiting the other port of the density separator, making a comparison of the ratio of the materials exiting the ports of the density separator to the known size at which particles are separated by the density separator, and using the result of said comparison to control the operation of at least one of said first density separator, second density separator, said pair of splitters, or said third density separator.

10. The method of claim 8 wherein the operation of said density separators is controlled by a controller.

11. The method of claim 10 wherein said controller transmits data to a remote computer.

12. The method of claim 10 wherein said controller receives programmable parameters from a remote computer.

13. The method of claim 10 wherein the controller determines the specific gravity and the height of the mixtures in the density separators such that these are maintained irrespective of the feed gradation or feed rate provided to the density separators.

* * * * *